US009187796B2

(12) United States Patent
Chang et al.

(10) Patent No.: US 9,187,796 B2
(45) Date of Patent: Nov. 17, 2015

(54) INNER-DIAMETER QUENCHING DEVICE

(71) Applicant: HIWIN TECHNOLOGIES CORP., Taichung (TW)

(72) Inventors: Shih-Tien Chang, Taichung (TW); Kun-Hung Chi, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 414 days.

(21) Appl. No.: 13/787,784

(22) Filed: Mar. 6, 2013

(65) Prior Publication Data

US 2014/0251391 A1 Sep. 11, 2014

(51) Int. Cl.
*C21D 1/667* (2006.01)

(52) U.S. Cl.
CPC ..... *C21D 1/667* (2013.01)

(58) Field of Classification Search
CPC ..... C21D 1/667
USPC ..... 266/123
See application file for complete search history.

(56) References Cited

U.S. PATENT DOCUMENTS 2,308,788 A * 1/1943 Somes ..... 266/123
2,743,099 A * 4/1956 Edwards et al. ..... 266/123

* cited by examiner

*Primary Examiner* — Scott Kastler
(74) *Attorney, Agent, or Firm* — Patent Office of Bang Shia

(57) ABSTRACT

An inner-diameter quenching device is provided with a workpiece holding assembly for holding a workpiece to be quenched, a spray cylinder, and a heating coil. The workpiece has a central axis. The spray cylinder is disposed at a first side of the workpiece holding assembly and driven by a lifting assembly to move along the central axis into an inner diameter of the workpiece. The heating coil is disposed at a second side of the workpiece holding assembly and located on and movable along the central axis. The heating coil and the spray cylinder are separated and movable in opposite directions along the same center axis, which can further reduce the size of the quenching device, making it suitable for quenching a small inner-diameter workpiece. Besides, the spray apertures are inclined, so that the cooling liquid can be sprayed out more easily to enhance the quenching effect.

9 Claims, 12 Drawing Sheets

INNER-DIAMETER QUENCHING DEVICE

BACKGROUND OF THE INVENTION

1. Field of the Invention

The present invention relates to a hot processing device, and more particularly to an inner-diameter quenching device.

2. Description of the Prior Art

Quenching is the rapid cooling of a metal material to obtain certain material properties. FIG. 1 shows a conventional quenching device 10 which is provided with a heating coil 11 and a cooling liquid output device 12, wherein the quenching device 10 moves in a workpiece to be quenched, so that the workpiece can be heated by the heating coil 11 and cooled down by the cooling liquid output device 12 at the same time. This conventional quenching device 10 is capable of heating and cooling, however, the heating coil 11 and the cooling liquid output device 12 have the same moving path, so that the arrangement of circuit line and pipeline is difficult and complicated, thus resulting in large size and complicated structure of the quenching device 10.

FIG. 2 shows another quenching device 20 which is also provided with a helical heating pipe 21 and a cooling liquid output pipe 22. The heating pipe 21 is used to heat a workpiece and then cooling liquid outputted from the cooling liquid output pipe 22 cools the workpiece down. This quenching device 20 also suffers from the same shortcomings as the conventional quenching device 20 does. Besides, the quenching effect of this quenching device 20 will not be good since it only has the single cooling liquid output pipe 22 to output cooling liquid.

The present invention has arisen to mitigate and/or obviate the afore-described disadvantages.

SUMMARY OF THE INVENTION

The primary objective of the present invention is to provide an inner-diameter quenching device which has simple structure and enhanced quenching efficiency.

To achieve the above objective, an inner-diameter quenching device in accordance with the present invention comprises:

a workpiece holding assembly for holding a workpiece to be quenched, the workpiece to be quenched has a central axis, and the workpiece holding assembly having a through hole;

a spray cylinder disposed at a first side of the workpiece holding assembly and driven by a lifting assembly to move along the central axis into an inner diameter of the workpiece to be quenched; and a heating coil disposed at a second side of the workpiece holding assembly and located on and movable along the central axis.

The heating coil and the spray cylinder are separated and movable in opposite directions along the same center axis, which can further reduce the size of the quenching device of the present invention, making it suitable for quenching a small inner-diameter workpiece. Besides, the spray apertures are inclined, so that the cooling liquid can be sprayed out more easily to enhance the quenching effect.

DETAILED DESCRIPTION OF THE PREFERRED EMBODIMENTS

Figure 1:
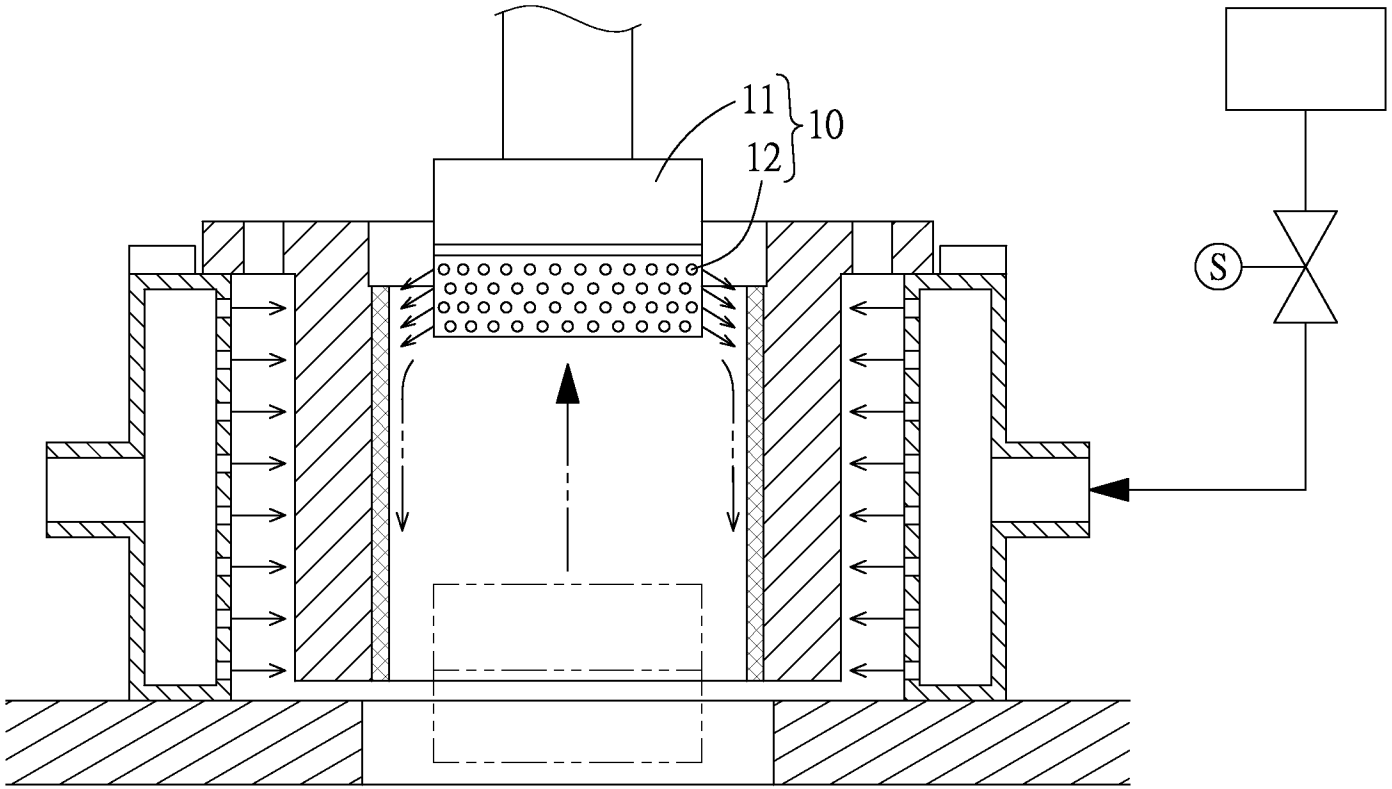
FIG.1 PRIOR ART
FIG. 1 illustrates a conventional quenching device.
Figure 2:
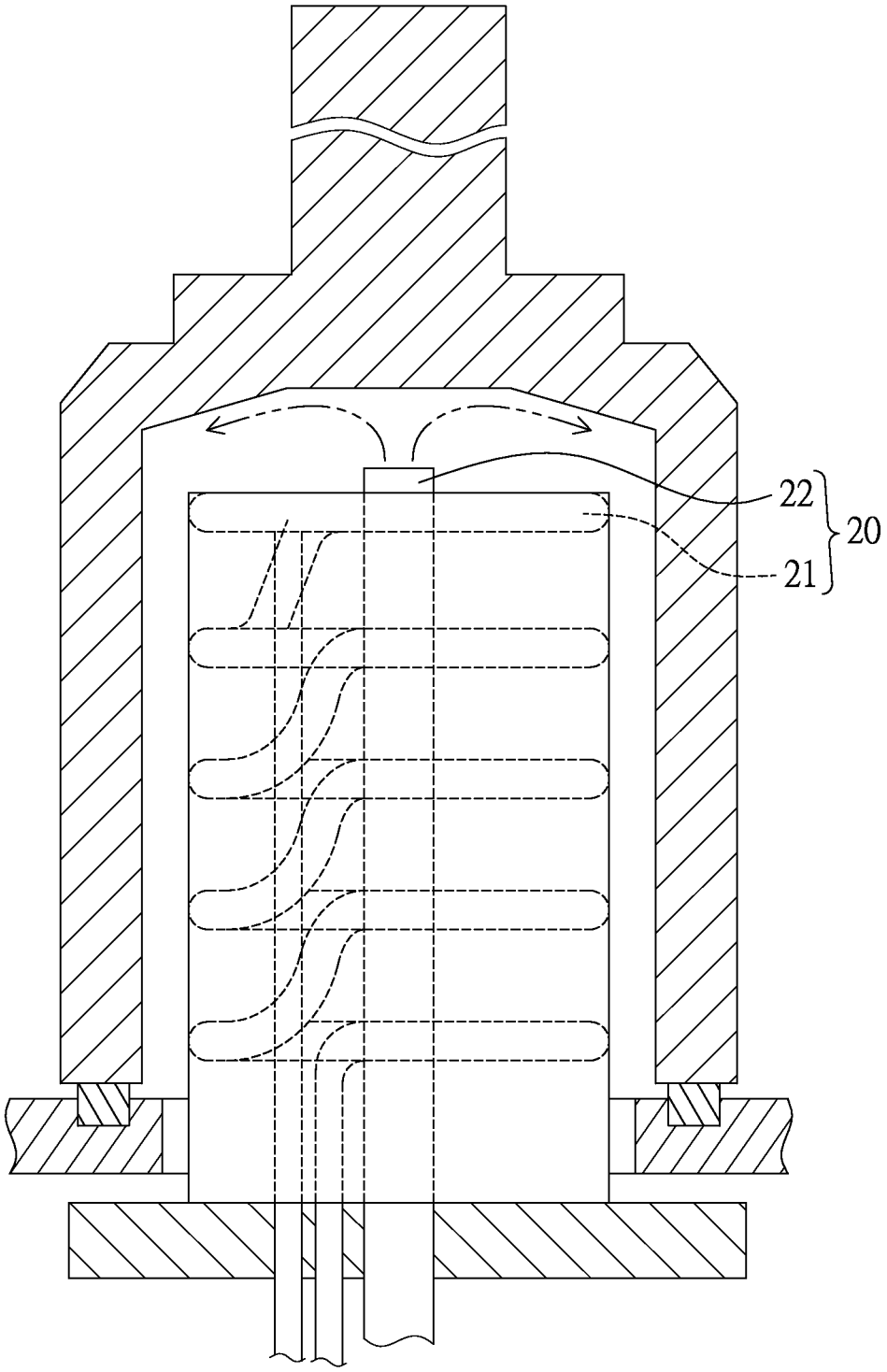
FIG.2 PRIOR ART
FIG. 2 shows another conventional quenching device.
Figure 3:
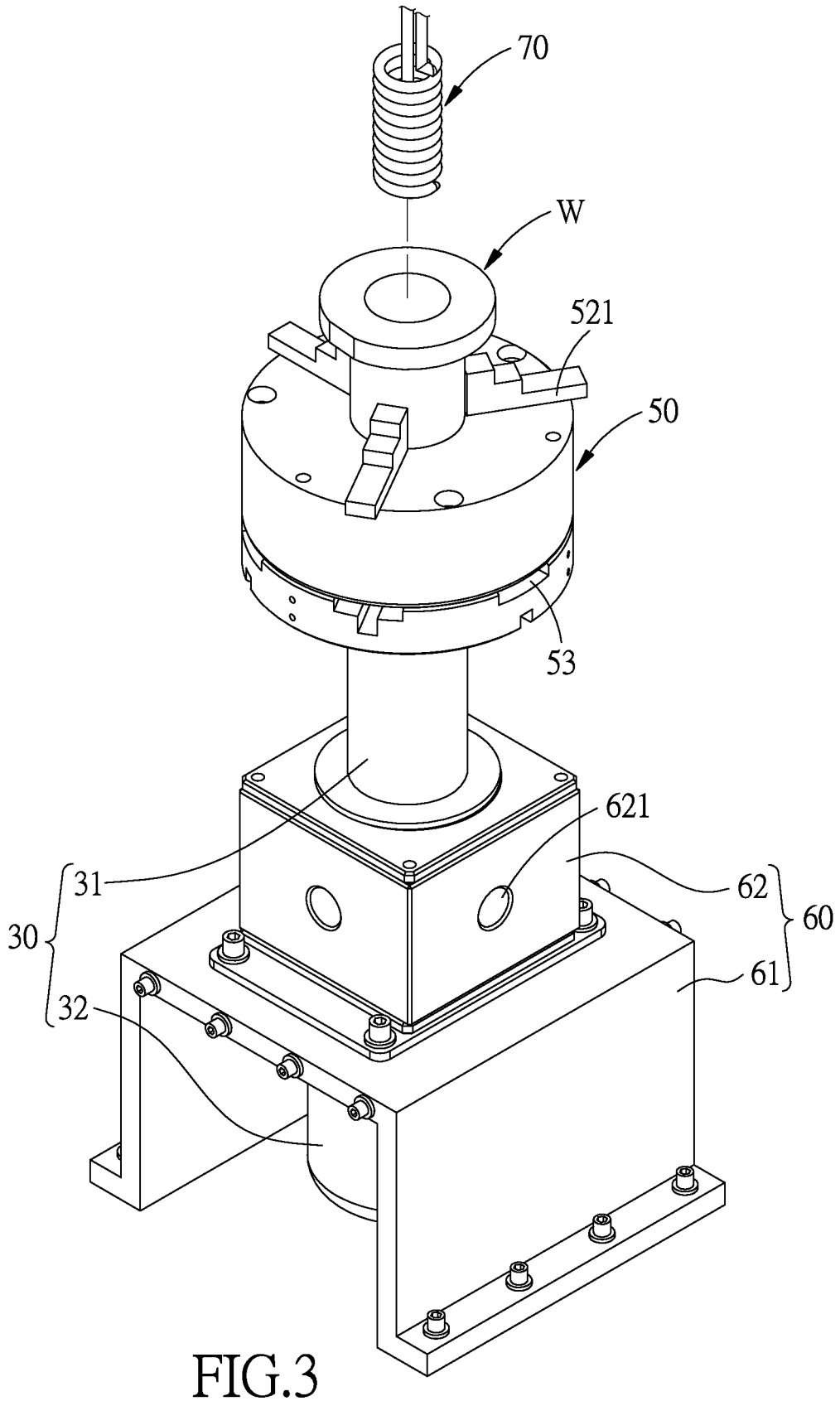
FIG. 3 is a perspective view of an inner-diameter quenching device in accordance with a first embodiment of the present invention.
Figure 4A:
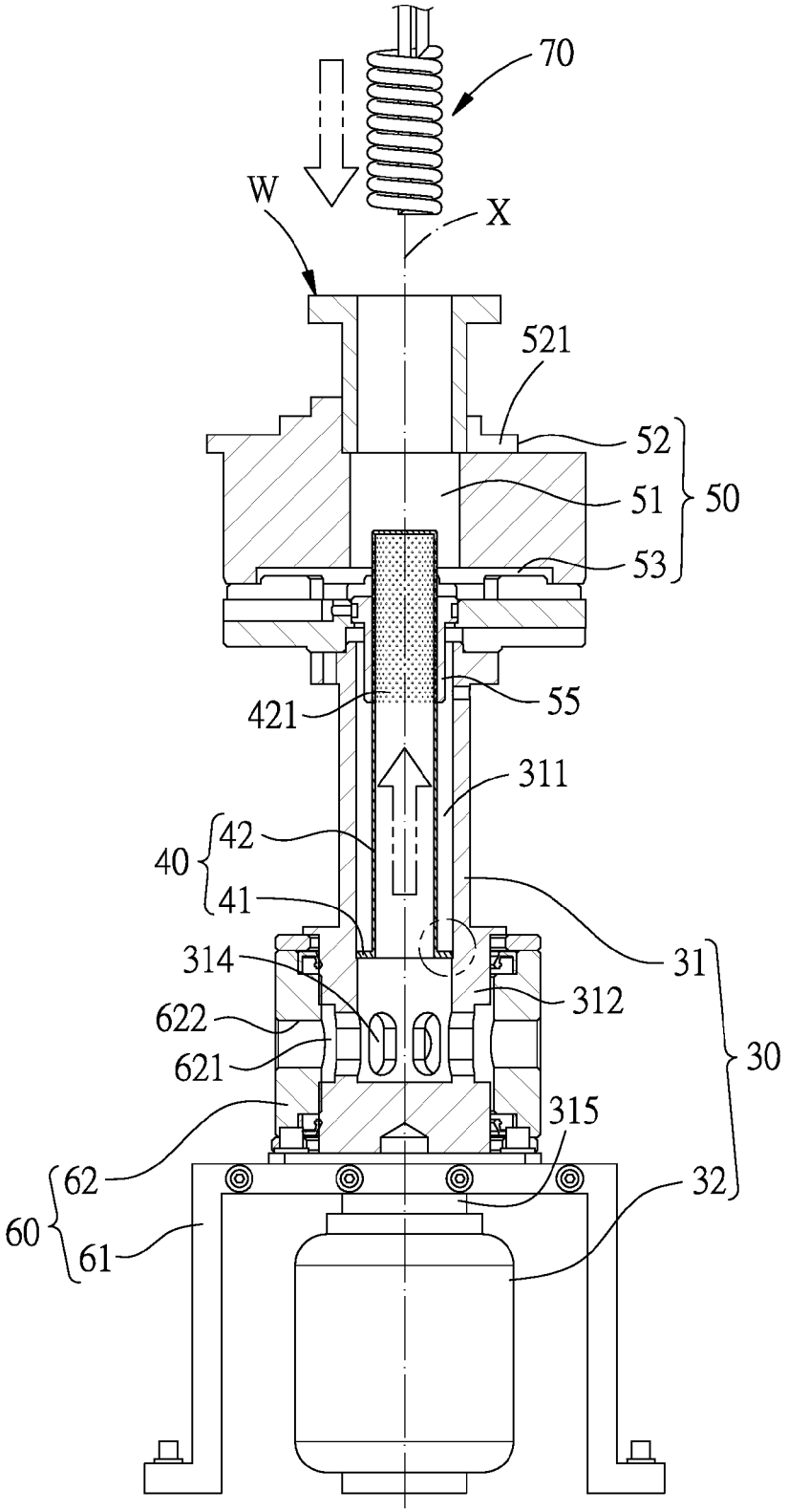
FIG. 4A is a cross sectional view of the inner-diameter quenching device in accordance with the first embodiment of the present invention.
Figure 4B:
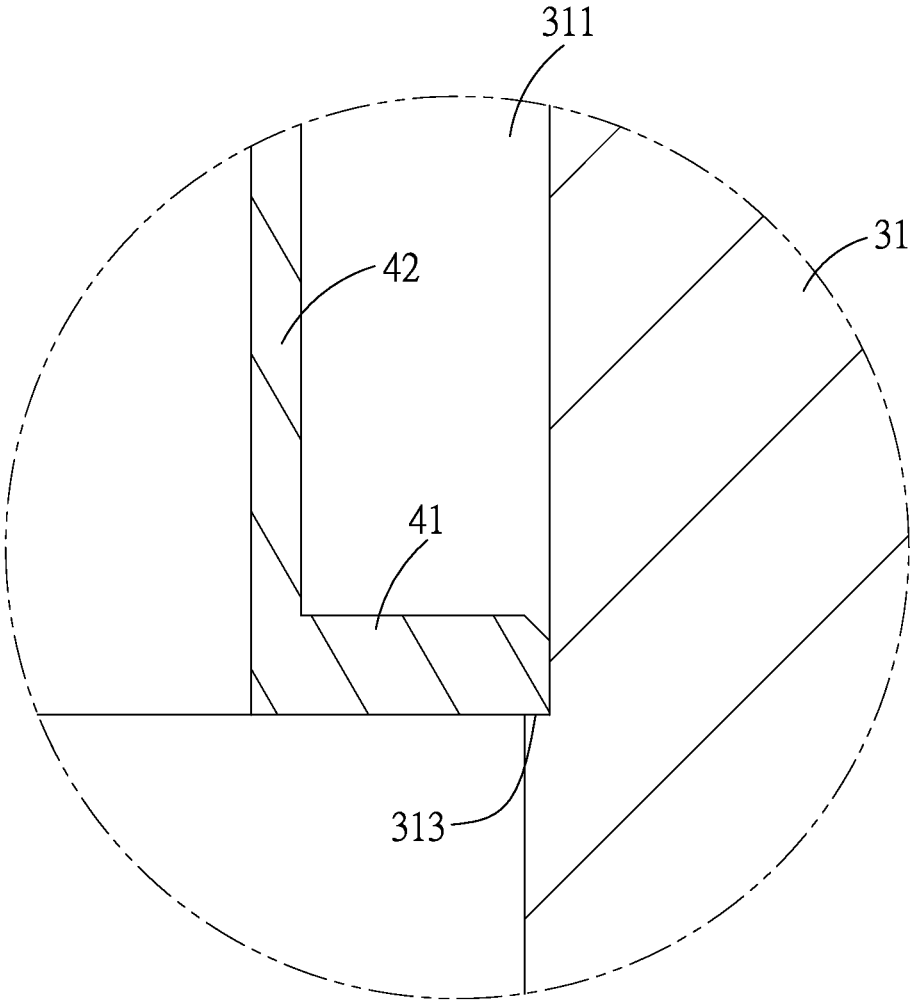
FIG. 4B is an enlarged view of a part of FIG. 4A.

The present invention will be clearer from the following description when viewed together with the accompanying drawings, which show, for purpose of illustrations only, the preferred embodiment in accordance with the present invention.

Referring to FIGS. 3-6, an inner-diameter quenching device in accordance with a first embodiment of the present invention is provided with a workpiece holding assembly 50 to hold a workpiece W to be quenched, and a heating coil 70 and a spray cylinder 40 move in the inner diameter of the workpiece W to be quenched. The workpiece W to be quenched has a central axis X, and the heating coil 70 and the spray cylinder 40 move in opposite directions along the central axis X. A rotation assembly 30 drives the workpiece holding assembly 50 to rotate about the central axis X, and a lifting assembly 60 drives the spray cylinder 40 to move upward along the central axis X.

The rotation assembly 30 includes a shaft 31 and a motor 32. The shaft 31 is a hollow structure formed with an inner space 311, and a first end of the shaft 31 is formed with an intake portion 312. In the inner space 311 is formed a shoulder portion 313, and the intake portion 312 is formed with a plurality of intake apertures 34 in communication with the inner space 311. The intake portion 312 is further provided with a driven portion 315 which is connected to and rotated by the motor 32 to rotate the shaft 31.

The spray cylinder 40 includes a terminal flange 41 and a hollow cylindrical body 42 with an outer diameter smaller that the outer diameter of the terminal flange 41. The spray cylinder 40 is disposed at a first side of the workpiece holding assembly 50 and located along the central axis X and can be moved along the central axis X to the inner space 311 of the shaft 31. The terminal flange 41 is stopped against the shoulder portion 313 and the cylindrical body 42 extends out of a second end of the shaft 31. The spray cylinder 40 is formed with a plurality of spray apertures 421, the cylindrical body 42 extends along the central axis X, and the spray apertures 421 are inclined toward the terminal flange 41 at an angle 0 with respect to the central axis X.

The workpiece holding assembly 50 is connected to and driven by the rotation assembly 30 to rotate about the central axis X. In this embodiment, the workpiece holding assembly 50 is fixed to the second end of the shaft 31 and includes a through hole 51, a clamping member 52 and a discharge channel 53. The through hole 51 is in communication with the inner space 311 of the shaft 31 and the discharge channel 53. The clamping member 52 is provided with a plurality of paws 521 which can move toward the through hole 51 to clamp the workpiece W to be quenched. Between the workpiece holding assembly 50 and the shaft 31 is disposed a sleeve 55. The cylindrical body 42 of the spray cylinder 40 is inserted through the sleeve 55 into the through hole 51 of the workpiece holding assembly 50, and the terminal flange 41 is restricted between the shoulder portion 313 and the sleeve 55.

The lifting assembly 60 includes a base 61 and a sucking member 62 which is fixed on the base 61 and provided with an assembling space 621. The sucking member 62 is provided around the peripheral surface thereof with a plurality of sucking apertures 622 in communication with the assembling space 621. The shaft 31 has the intake portion 312 pivotally disposed on the sucking member 62 in such a manner that the driven portion 315 of the intake portion 312 is inserted through the base 61 and connected to the motor 32, so that the shaft 31 can be rotated by the motor 32, and the intake apertures 314 of the shaft 31 are aligned with the sucking apertures 622 of the sucking member 62. By such arrangements, cooling liquid is inputted into the lifting assembly 60 to drive the spray cylinder 40 which is disposed in the shaft 31 to move along the central axis X, and the spray cylinder 40 can move into the inner diameter of the workpiece W to be quenched via the through hole 51 of the workpiece holding assembly 50.

The heating coil 70 is movably disposed at a second side of the workpiece holding assembly 50, located on the central axis X and can move with respect to the workpiece holding assembly 50 by moving along the central axis X.

Figure 5:
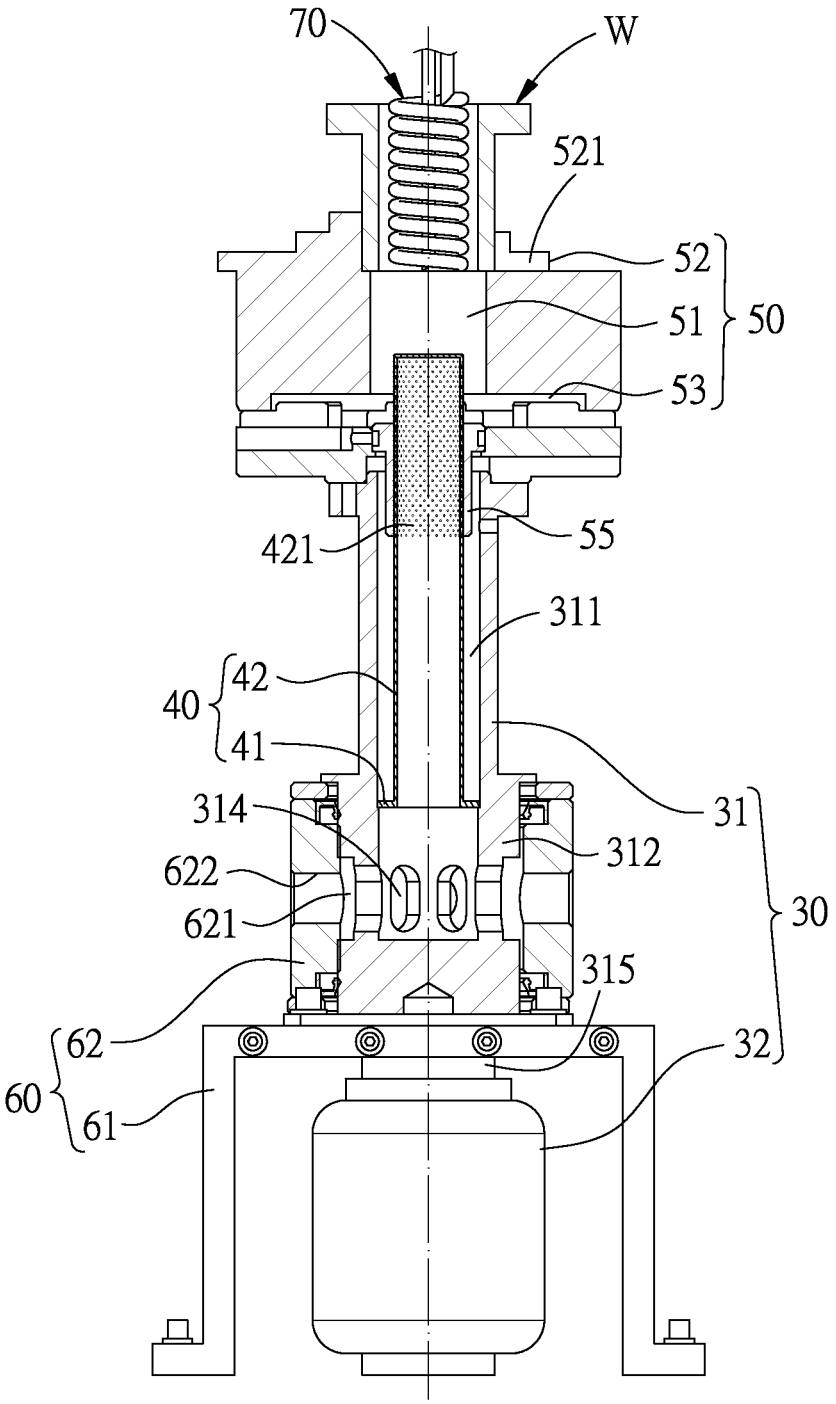
FIG. 5 is an operational view of the inner-diameter quenching device in accordance with the first embodiment of the present invention, wherein the heating coil is inserted into the inner diameter of the workpiece to perform heating process.
Figure 6A:
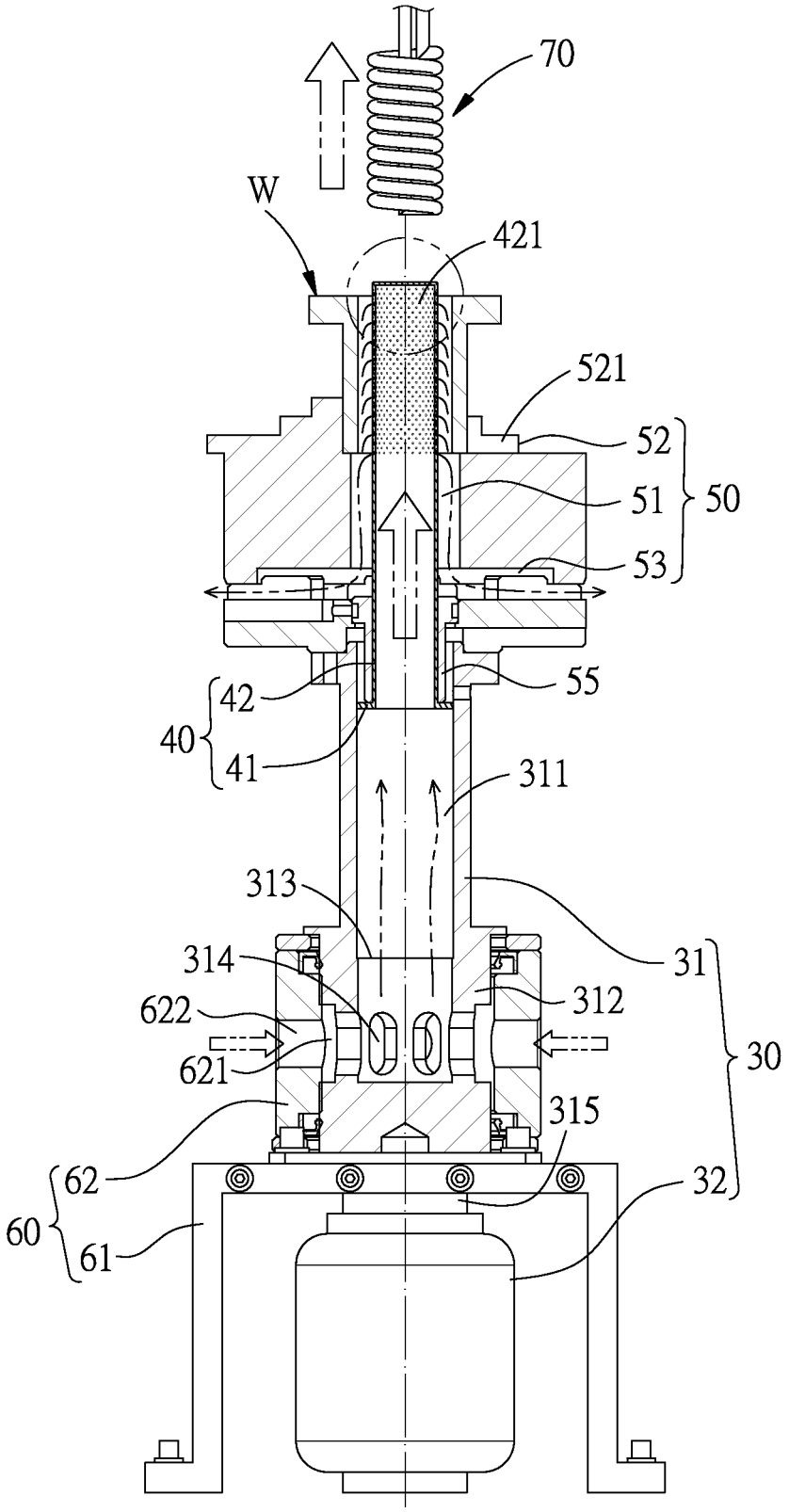
FIG. 6A is an operational view of the inner-diameter quenching device in accordance with the first embodiment of the present invention, wherein the heating coil is withdrawn from the inner diameter of the workpiece, and the spray cylinder is inserted into the inner diameter of the workpiece to perform cooling process.
Figure 6B:
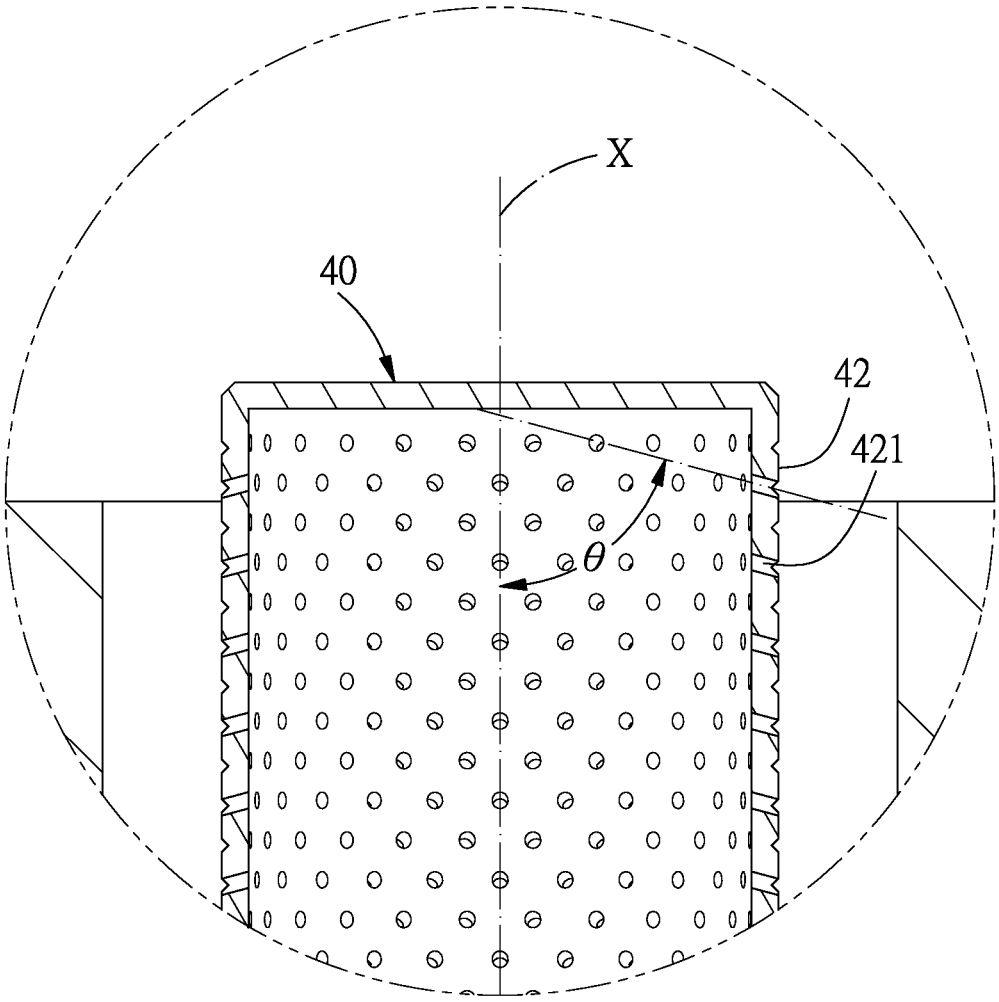
FIG. 6B is an enlarged view of a part of FIG. 6A.
Figure 7:
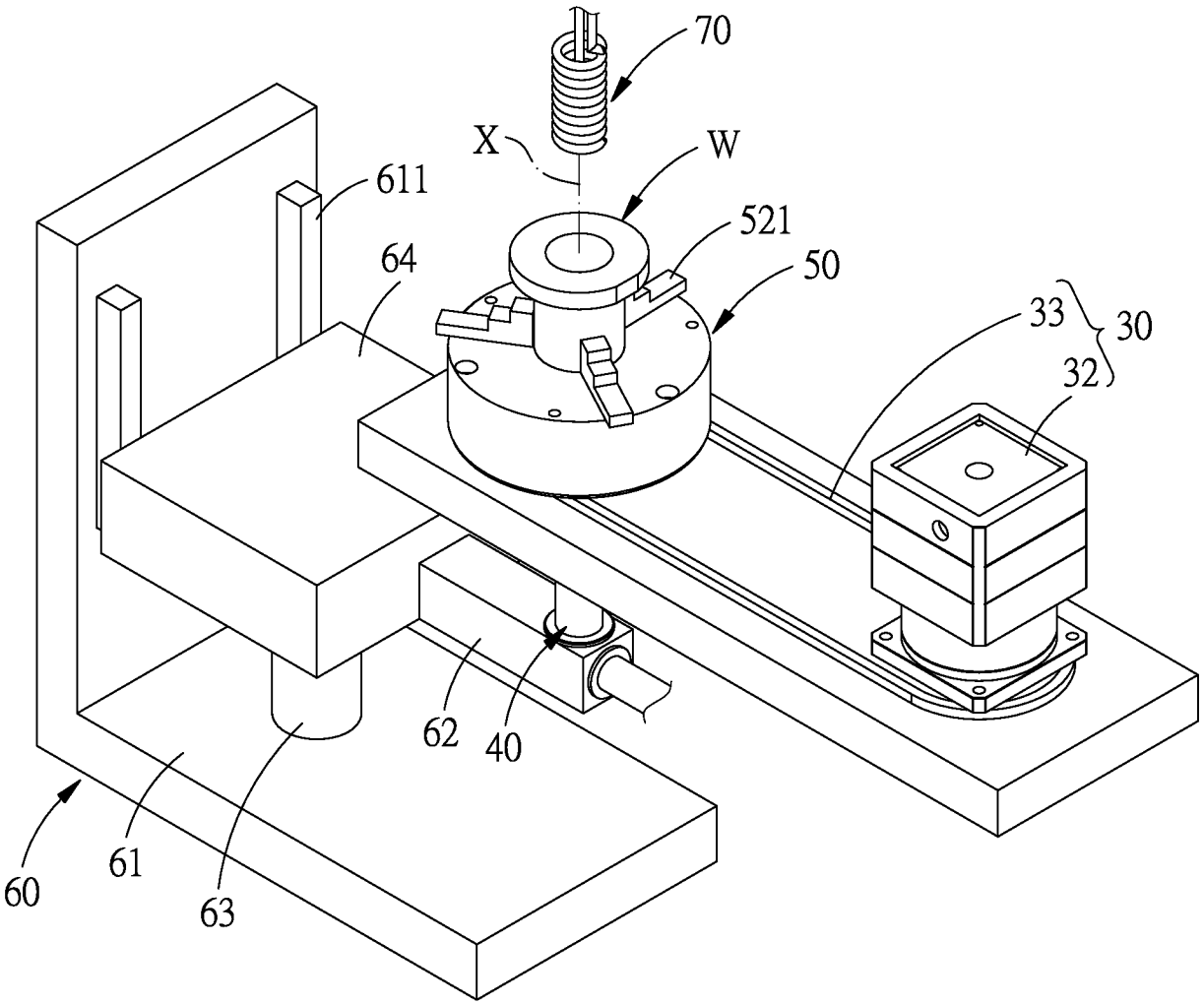
FIG. 7 is a perspective view of an inner-diameter quenching device in accordance with a second embodiment of the present invention.
Figure 8:
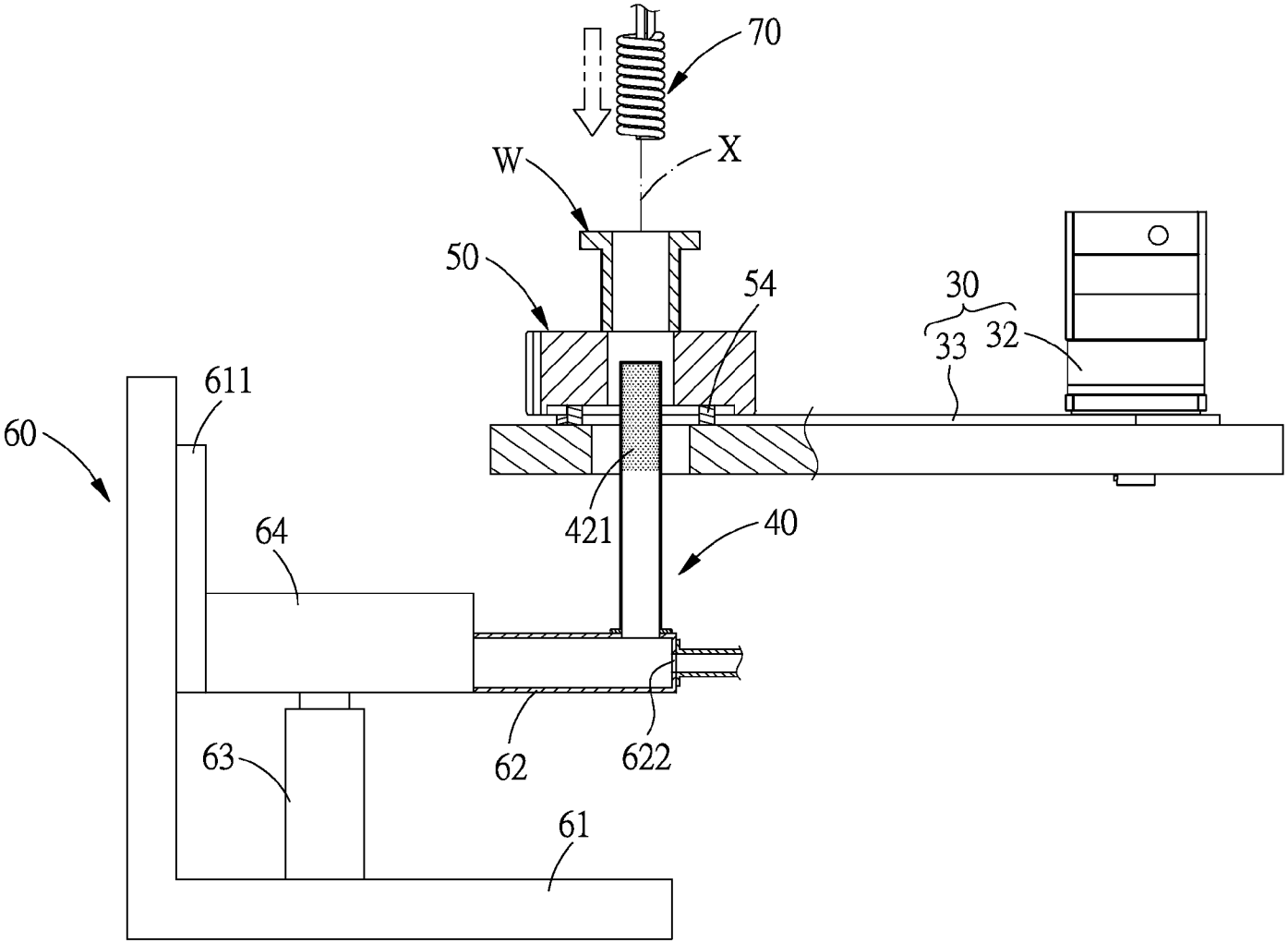
FIG. 8 is a cross sectional view of the inner-diameter quenching device in accordance with the second embodiment of the present invention.

When in use, as shown in FIGS. 5 and 6, the workpiece holding assembly 50 use the paws 521 to clamp the workpiece W, and then the heating coil 70 moves along the central axis X into the inner diameter of the workpiece W to be quenched to heat the workpiece W.

When the workpiece W is heated to a quenching temperature, the heating coil 70 moves along the central axis X away from the workpiece W. Then cooling liquid is continuously sucked into the assembling space 621 of the sucking member 62 via the sucking apertures 622 and flows into the inner space 311 of the shaft 31 via the intake apertures 314 to push the spray cylinder 40 which is disposed in the shaft 31 to move, so that the terminal flange 41 of the spray cylinder 40 will move away from the shoulder portion 313 toward the workpiece W to be quenched until the it rests against the sleeve 55. At this moment, the sucking member 62 keeps drawing cooling liquid to make the cooling liquid spray out of the spray apertures 421 of the spray cylinder 40 and onto the inner diameter of the workpiece W, producing a rapid cooling (quenching) effect. The spray apertures 421 are inclined, so that the cooling liquid can be sprayed out more easily to enhance the quenching effect. Furthermore, during quenching, cooling liquid is continuously drawn by the sucking member 62 and finally discharged from the discharge channel 53. When quenching is done, and the sucking member 62 stops drawing cooling water, the power for pushing the spray cylinder 40 upward will disappear, and the spray cylinder 40 thus will return back down to the original position, and thus the quenching of the workpiece W is finished.

FIGS. 7-10 show a second embodiment of the present invention, the heating coil 70 and the spray cylinder 40 still move within the inner diameter of the workpiece W to be quenched and move in opposite directions along the central axis X, and the difference of the second embodiment from the first embodiment is described as follows:

The rotation assembly 30 includes a motor 32 and a belt 33 which wraps around the motor 32 and a driven shaft 54 of the workpiece holding assembly 50, so that the workpiece holding assembly 50 can be rotated by the rotation assembly 30.

The lifting assembly 60 includes a base 61, a pressure cylinder 63 and a drive platform 64. On the base 61 are arranged a plurality of rails 611. The pressure cylinder 63 is disposed on the base 61 and connected to the drive platform 64 which is movably disposed on the rails 611, so that the pressure cylinder 63 drives the drive platform 64 to move up and down along the rails 611. On the drive platform 64 is disposed a sucking member 62 which is a hollow structure. The spray cylinder 40 is fixed on the sucking member 62 and in communication with the inner space of the sucking member 62, and the sucking member 62 is formed with a sucking aperture 622 which is in communication with the inner space of the sucking member 62.

Figure 9:
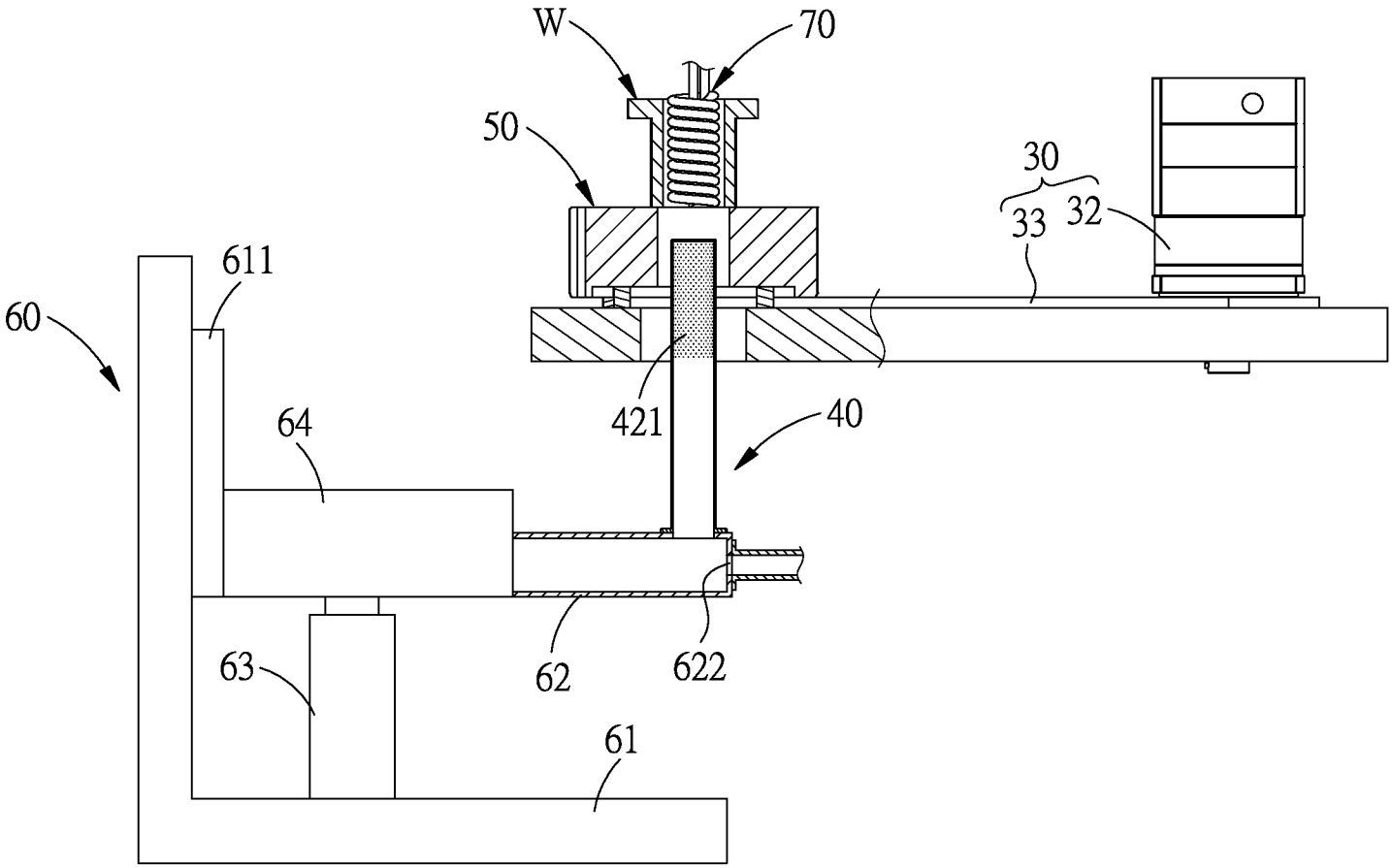
FIG. 9 is an operational view of the inner-diameter quenching device in accordance with the second embodiment of the present invention, wherein the heating coil is withdrawn from the inner diameter of the workpiece, and the spray cylinder is inserted into the inner diameter of the workpiece to perform cooling process.
Figure 10:
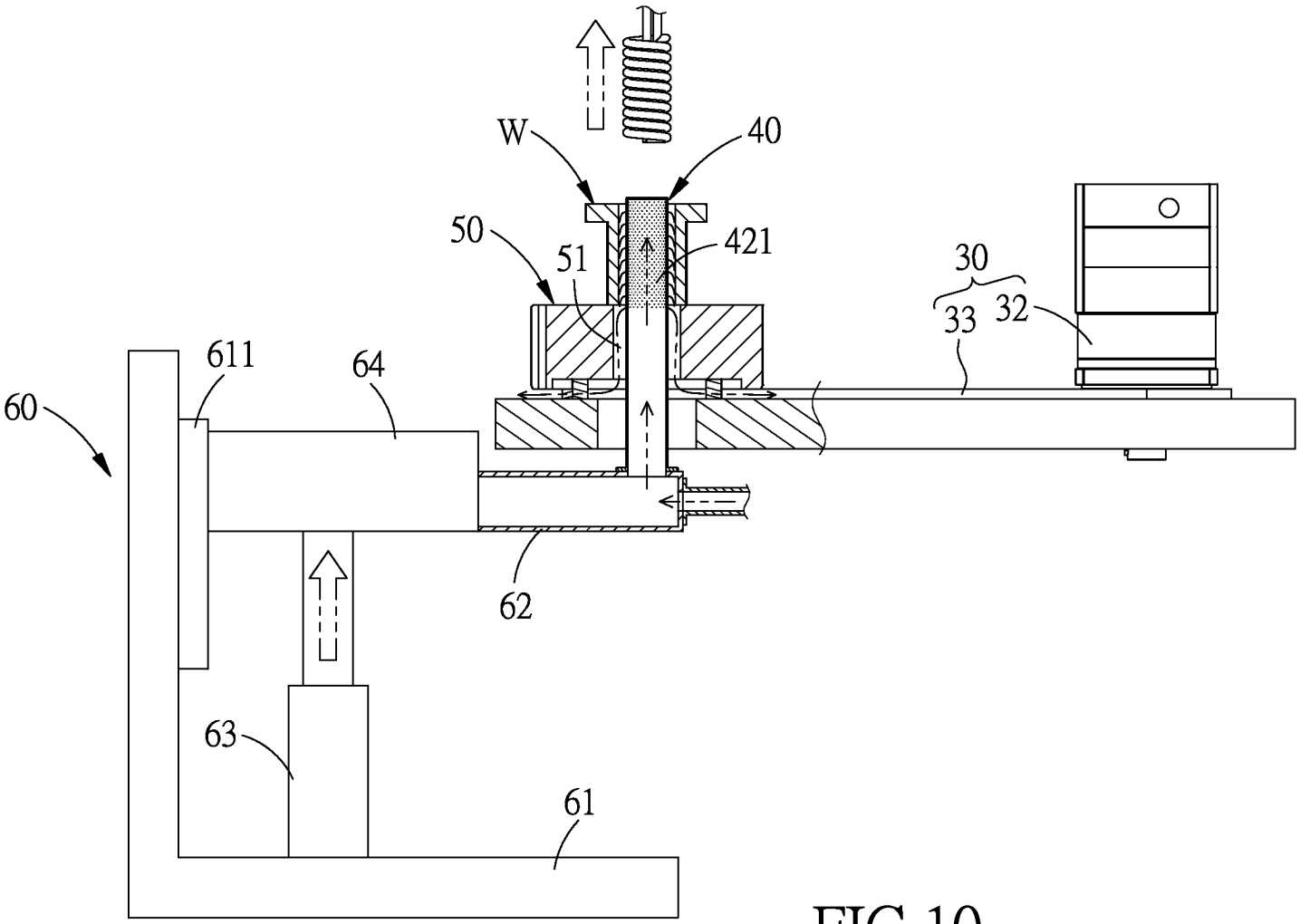
FIG. 10 is an operational view of the inner-diameter quenching device in accordance with the second embodiment of the present invention, wherein the heating coil is withdrawn from the inner diameter of the workpiece, and the spray cylinder is inserted into the inner diameter of the workpiece to perform cooling process.

Similarly, the heating coil 70 can also move along the central axis X to heat the workpiece W by moving into the inner diameter of the workpiece W, as shown in FIG. 9, then return from the inner diameter of the workpiece W after heating, as shown in FIG. 10. After that, the pressure cylinder 63 of the lifting assembly 60 pushes the sucking member 62 which is disposed on the drive platform 64 upward, and the sucking member 62 drives the spray cylinder 40 to move upward into the inner diameter of the workpiece W to be quenched, so that cooling liquid can be sucked into the sucking aperture 622 and sprayed out of the spray apertures 421 of the spray cylinder 40 to produce a quenching effect.

It is learned from the above description that the structure of the present invention is quite simple, which reduces the structure and assembly cost. Further, the arrangement of the heating coil 70 and the spray cylinder 40 being separated and movable in opposite directions along the same center axis X can further reduce the size of the quenching device of the present invention, making it suitable for quenching a small inner-diameter workpiece. Besides, the spray apertures 421 are inclined, so that the cooling liquid can be sprayed out more easily to enhance the quenching effect.

While we have shown and described various embodiments in accordance with the present invention, it is clear to those skilled in the art that further embodiments may be made without departing from the scope of the present invention.

What is claimed is:

1. An inner-diameter quenching device comprising:

a workpiece holding assembly for holding a workpiece to be quenched, the workpiece to be quenched having a central axis, and the workpiece holding assembly having a through hole;

a spray cylinder disposed at a first side of the workpiece holding assembly and driven by a lifting assembly to move along the central axis into an inner diameter of the workpiece to be quenched; and a heating coil disposed at a second side of the workpiece holding assembly and located on and movable along the central axis;

wherein the lifting assembly includes a sucking member which is provided with an assembling space and provided around a peripheral surface thereof with a plurality of sucking apertures in communication with the assembling space, a rotation assembly drives the workpiece holding assembly to rotate about the central axis and includes a shaft, the shaft is a hollow structure formed with an inner space and has a first end formed with an intake portion and a second end connected to the workpiece holding assembly, in the inner space is formed a shoulder portion, and the intake portion is formed with a plurality of intake apertures in communication with the inner space of the shaft, the shaft has the intake portion pivotally disposed on the sucking member in such a manner that the driven portion of the intake portion is inserted through the base, and the intake apertures of the shaft are aligned with the sucking apertures of the sucking member, the spray cylinder is able to move into the inner space of the shaft, the lifting assembly use cooling liquid to push the spray cylinder to move up and down along the central axis.

2. The inner-diameter quenching device as claimed in claim 1, wherein the spray cylinder is formed with a plurality of spray apertures which are inclined toward a terminal flange at an angle with respect to the central axis.

3. The inner-diameter quenching device as claimed in claim 1 further comprises a rotation assembly driving the workpiece holding assembly to rotate about the central axis.

4. The inner-diameter quenching device as claimed in claim 1, wherein the lifting assembly further includes a base on which is disposed the sucking member, the intake portion is further provided with a driven portion which is connected to and rotated by a motor of the rotation assembly to rotate the shaft.

5. The inner-diameter quenching device as claimed in claim 1, wherein the workpiece holding assembly includes a through hole, a clamping member and a discharge channel, the through hole is in communication with the inner space of the shaft and the discharge channel, the clamping member is provided with a plurality of paws which is able to move toward the through hole to clamp the workpiece to be quenched.

6. The inner-diameter quenching device as claimed in claim 1, wherein a sleeve is disposed between the workpiece holding assembly and the shaft, the spray cylinder includes a terminal flange and a hollow cylindrical body, the spray cylinder is disposed at a first side of the workpiece holding assembly and located along the central axis and can be moved along the central axis to the inner space of the shaft, the terminal flange is stopped against the shoulder portion and the cylindrical body is inserted through the sleeve and into the workpiece holding assembly, and the terminal flange is restricted between the shoulder portion and the sleeve, the spray cylinder is formed with a plurality of spray apertures, the cylindrical body extends along the central axis, and the spray apertures are inclined toward the terminal flange.

7. The inner-diameter quenching device as claimed in claim 1, wherein the lifting assembly includes a pressure cylinder and a drive platform, the pressure cylinder is disposed on the base and connected to and drives the drive platform to move up and down, on the drive platform is disposed a sucking member which is a hollow structure, the spray cylinder is fixed on the sucking member and in communication with an inner space of the sucking member, and the sucking member is formed with a sucking aperture which is in communication with the inner space of the sucking member.

8. The inner-diameter quenching device as claimed in claim 7, wherein the lifting assembly includes a base and a plurality of rails arranged on the base, the pressure cylinder is disposed on the base and connected to the drive platform which is movably disposed on the rails.

9. The inner-diameter quenching device as claimed in claim 3, wherein the rotation assembly includes a motor and a belt which wraps around the motor and a driven shaft of the workpiece holding assembly, so that the workpiece holding assembly is rotated by the rotation assembly.

* * * * *